US006210155B1

(12) United States Patent
Bernard et al.

(10) Patent No.: US 6,210,155 B1
(45) Date of Patent: Apr. 3, 2001

(54) CHARGING DEVICE FOR A ROTARY HEARTH FURNACE

(75) Inventors: Gilbert Bernard, Helmdange; Emile Lonardi, Bascharage; Romain Frieden, Beidweiler; Patrick Hutmacher, Bettembourg, all of (LU)

(73) Assignee: Paul Wurth, S.A. (LU)

( * ) Notice: Subject to any disclaimer, the term of this patent is extended or adjusted under 35 U.S.C. 154(b) by 0 days.

(21) Appl. No.: 09/424,759

(22) PCT Filed: May 13, 1998

(86) PCT No.: PCT/EP98/02796

§ 371 Date: Dec. 20, 1999

§ 102(e) Date: Dec. 20, 1999

(87) PCT Pub. No.: WO98/54526

PCT Pub. Date: Dec. 3, 1998

(30) Foreign Application Priority Data

May 30, 1997 (LU) ..... 90072

(51) Int. Cl.[7] ..... F27B 9/16

(52) U.S. Cl. ..... 432/124; 432/61; 432/138; 432/139; 432/195; 414/588

(58) Field of Search ..... 432/61, 124, 138, 432/139, 141, 192, 195; 414/149, 158, 163, 195, 588; 266/173

(56) References Cited

U.S. PATENT DOCUMENTS

| | | | | |
|---|---|---|---|---|
| Re. 33,935 | * | 5/1992 | Fujimoto et al. | 266/178 |
| 2,211,957 | | 8/1940 | MacMichael . | |
| 3,799,368 | * | 3/1974 | Wieczorek | 414/588 |
| 3,947,239 | | 3/1976 | Nelson . | |
| 4,029,220 | * | 6/1977 | Greaves | 414/588 |
| 5,022,806 | * | 6/1991 | Lonardi et al. | 414/588 |
| 5,895,215 | * | 4/1999 | Rinker et al. | 432/138 |
| 5,944,514 | * | 8/1999 | Pohl et al. | 432/138 |

FOREIGN PATENT DOCUMENTS

| | | |
|---|---|---|
| 94 1156 | 7/1949 | (DE) . |
| 1 289 490 | 2/1969 | (DE) . |
| 24 53 613 | 5/1975 | (DE) . |
| 28 14 494 | 10/1979 | (DE) . |
| 1.582.172 | 9/1969 | (FR) . |
| WO 86/01819 | 3/1986 | (WO) . |
| WO 97/33135 | 9/1997 | (WO) . |
| WO 97/46844 | 12/1997 | (WO) . |

OTHER PUBLICATIONS

Abstract for CA 2030831 A 910529 Derwent Publ. week 9132 X POO2078725 (May 29, 1991).

* cited by examiner

*Primary Examiner*—Gregory Wilson
(74) *Attorney, Agent, or Firm*—Smith, Gambrell & Russell

(57) ABSTRACT

The invention relates to a charging device for creating superimposed layers of fine-grained bulk material on a rotating hearth (2). For each layer of bulk material to be charged, said charging device comprises a discharge hopper (22) having an outflow slot (36) and a discharge roller (42) positioned ahead of each outflow slot (26). Said outflow slot (36) and discharge roller (42) extend essentially at a right angle to the direction of rotation of the rotating hearth and the discharge roller (42) has a drive (44), the rotational frequency of which can be controlled.

16 Claims, 10 Drawing Sheets

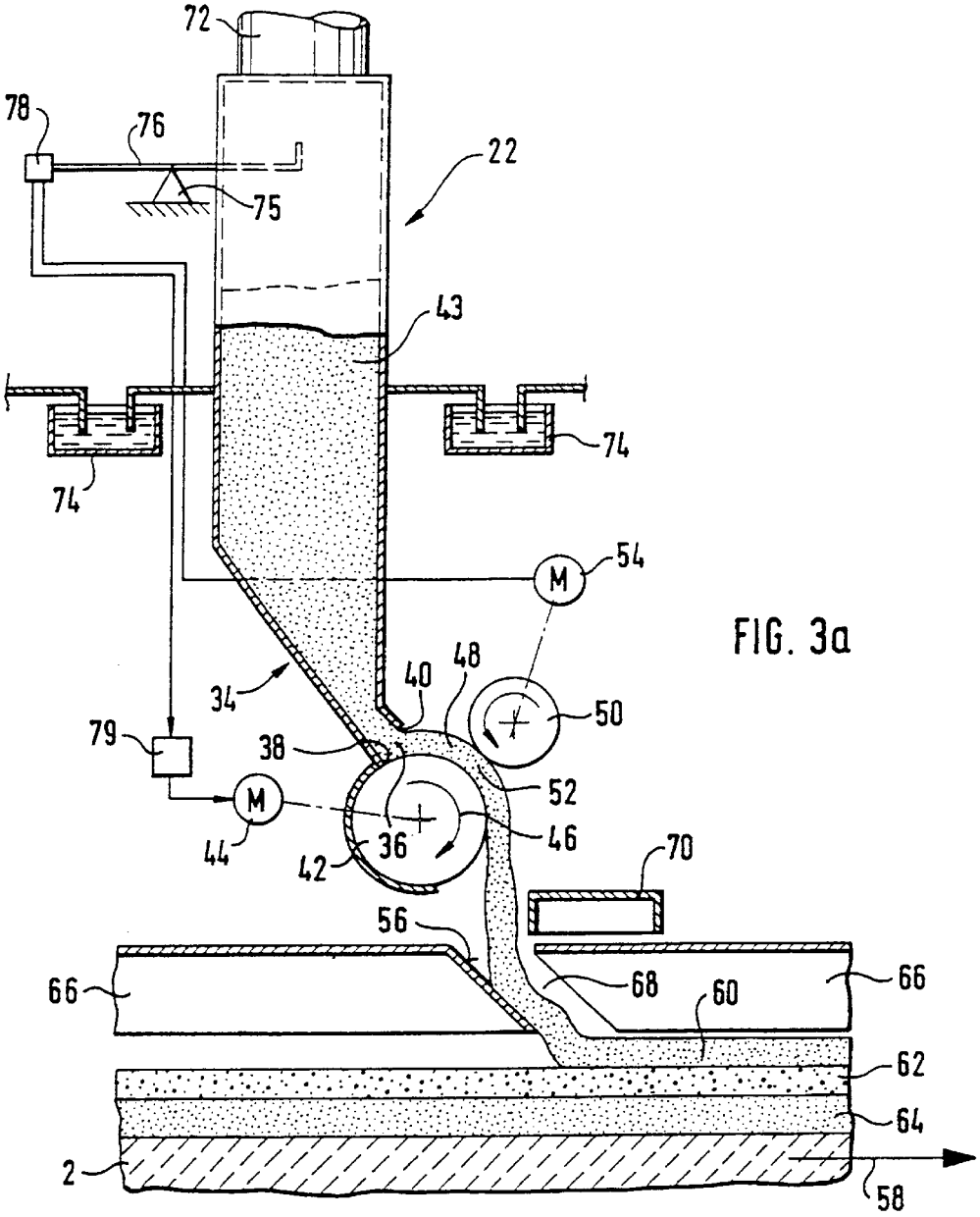
FIG. 3a
FIG. 3b
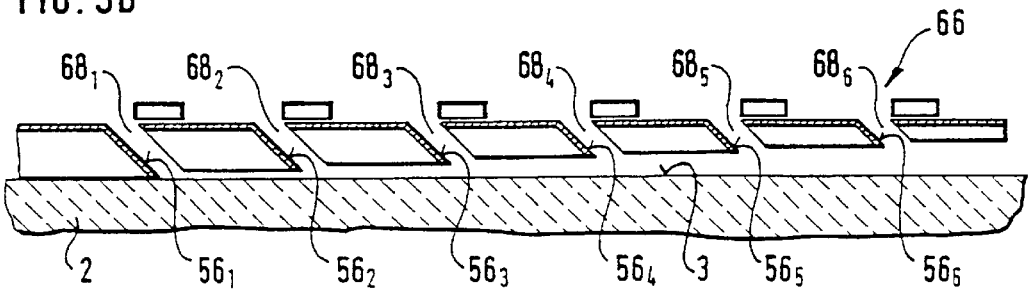

CHARGING DEVICE FOR A ROTARY HEARTH FURNACE

CROSS REFERENCE TO RELATED APPLICATIONS

This is a 371 of Application No. PCT/EP98/02796, filed on May 13, 1998.

BACKGROUND OF THE INVENTION

The invention relates to a charging device for production of layers of fine-grained loose material one above the other on a rotary hearth. It is particularly suitable for the use of a new direct iron ore reduction process in a rotary hearth furnace.

Sponge iron is produced in a direct reduction process by the reduction of iron oxide with solid or gaseous reducing agents. Carbon, for example, which reacts with oxygen at higher temperatures and forms the reducing gas CO, serves as a solid reducing agent. A process of this type can be carried out, for example, in a rotary hearth furnace, i.e. in a furnace with a rotatable annular furnace bottom, which is lined with refractory material on the top side and is enclosed by a housing. Burners, which penetrate the housing and heat its interior to the required reaction temperature of over 1000° C., are mounted on the top side of the housing.

The iron oxide is deposited together with the reducing agent at a first point of the rotary hearth furnace and is fed by rotation of the rotary hearth to the interior of the housing, where it reacts with the reducing agent because of the high temperatures and is present as directly reduced iron after about one revolution of the rotary hearth. The form in which the iron is present depends on the type of process used.

In the traditional process the iron oxide is compacted before charging into the rotary hearth furnace with the reducing agent to form pellets, which are subsequently charged on to the rotary hearth of the furnace. Inside the furnace, the iron oxide in the individual pellets reacts with the carbon monoxide released by the carbon in a controlled atmosphere and is reduced to iron inside the pellets. The sponge iron is thus present in pellet form after the reduction. The pellets additionally containing the residues of the reducing agent (ash) as well as any impurities such as sulphur. After the reduction process a further process step, in which the directly reduced iron is separated from the ash and impurities, is consequently required.

In an alternative process fine-grained iron oxide and fine-grained reducing agent, e.g. coal, are charged in separate layers on to the rotary hearth of the furnace. In this process only one layer of iron oxide and one layer of reducing agent can be charged or several layers of the individual materials can be placed alternately in layers one above the other. On passage through the furnace carbon monoxide, which penetrates through the fine-grained iron oxide layers and reduces them to iron, is released in the coal layer(s). Consequently the reduced iron is present in a pure form in one or more layers above each other after the reduction process, the individual iron layers being separated from each other by layers of reducing agent residues and these ash layers being present in loose form.

As the individual layers of loose material do not mix with each other during the reduction process, this process offers the advantage that the sponge iron and reducing agent residues can easily be separated from each other. The basic prerequisite for economic implementation of this reduction process, however, is that the charging device of the rotary hearth furnace is capable of producing an optimum layered arrangement of the metal oxide and reducing agent on the rotary hearth. Consequently a task of the invention is to create a rotary hearth furnace, the charging device of which largely meets this prerequisite.

SUMMARY OF THE INVENTION

This problem is solved by the charging device according to this invention.

In the reducing furnace described above a charging device according to the invention consequently has a discharge bunker with a discharge slot and a discharge roller in front of the discharge slot for each metal oxide or reducing agent layer. The discharge slot and discharge roller extend essentially transversely to the direction of rotation of the rotary hearth and the discharge rollers have a variable-speed drive. If the speed of rotation of a discharge roller is increased, the discharge of loose material from the corresponding discharge bunker also increases. If, by contrast, the speed of rotation of a discharge roller is reduced, the discharge of loose material from the corresponding discharge bunker is also reduced. With the charging device according to the invention, metal oxide and reducing agent layers one above the other can thus be deposited on the annular furnace bottom. The ratio of metal oxide to reducing agent in the layers is adaptable to an optimum course of the reduction process via the variable-speed discharge rollers. By briefly stopping a discharge roller a layer can also be interrupted, so that heaps arranged behind each other are formed in the direction of rotation. Such a discontinuous layer simplifies, for example, discharge of the metallic sponge produced, because a continuous strand of material is not formed, but individual pieces of sponge separated from each other.

The reduction process can be further optimised by gravimetric control of the layer build-up. For this purpose the device according to the invention need only have continuous weighing devices, which are integrated in the charging device in such a way that the discharge of metal oxides and reducing agents in loose form can be measured gravimetrically. A speed control system for the variable-speed drives of the discharge rollers controls in this case the speed of the discharge rollers as a function of the corresponding gravimetric measured values of the weighing devices.

In a first embodiment of the weighing device, the discharge bunkers for the metal oxide and for the reducing agent are connected to a storage bunker for the metal oxide or reducing agent, although they can be moved in a vertical direction relative to the respective storage bunker and are suspended by weight measuring cells above the rotary hearth. In this embodiment the discharge of loose material from each discharge bunker can be measured separately, so that the build-up of each individual layer can be controlled gravimetrically.

In a second embodiment of the weighing device the discharge bunkers for the metal oxide together with a storage bunker for the metal oxide form a first separate unit, which is suspended by weight measuring cells above the rotary hearth, and the discharge bunkers for the reducing agents together with a storage bunker for the reducing agents form a second unit, which is suspended by weight measuring cells above the rotary hearth. In this embodiment the total loose material discharge from the storage bunker for the metal oxide and the storage bunker for the reducing agent can be measured separately by gravimetry, so that the total build-up of the metal oxide layers and the total build-up of the reducing agent layers can be adapted to each other gravimetrically.

To prevent mixing of the layers at the interfaces as far as possible and thus ensure a clean boundary layer build-up between the individual layers, a guide section is advantageously arranged under each of the discharge rollers in such a way that the loose material falling from the roller falls on to the guide section and is guided by the latter at a reduced speed on to the top layer in each case.

The discharge bunkers advantageously each have a discharge hopper, a slot-type discharge opening being formed between two free edges. The first edge rests against the discharge roller and the second edge is arranged a certain distance from the surface of the discharge roller, so that a discharge slot, which determines the layer thickness of the loose material on the discharge roller by scraping, is formed between the discharge roller and the second edge. In other words the layer thickness of the loose material on the discharge roller is determined by a scraping edge, so that the layer thickness of the loose material on the discharge roller is independent of the angle of slope of the loose material. In addition the scraping produces more uniform distribution of the loose material over the full width of the discharge roller.

The charging device advantageously has a second driven roller. This second roller, which is also designated a separating roller, defines with the discharge roller a second discharge slot, the height of which is slightly smaller than the height of the discharge slot between the discharge roller and the second edge. During operation the separating roller has a higher circumferential speed than the discharge roller, so that it accelerates the loose material relative to the discharge roller and ensures early falling of the loose material from the discharge roller. Consequently it helps to prevent the loose material falling in more or less large blocks in an uncontrolled manner from the discharge roller as a result of the sole effect of gravity, which would lead to a different apparent density.

It is also advantageous to provide the discharge bunker with a discharge hopper which is designed in such a way that the total weight of the loose material column in the discharge bunker rests on the walls of this discharge bunker.

To ensure uniform loading of the annular furnace bottom in the radial direction (i.e. according to the width), the discharge roller may be conical, for example, the diameter decreasing towards the centre of the rotary hearth. However, the same result can likewise be achieved, if the height of the discharge slot decreases towards the centre of the rotary hearth.

The discharge roller may have a continuous surface. However, it may also be designed as a type of bucket wheel.

To prevent escape of the process gases during reduction, the charging device sealed by water channels is advantageously integrated in a closed casing.

To supply the individual discharge bunkers with loose material, each discharge bunker is preferably connected via a conveyor to a storage bunker, the conveyor having several discharge points into the discharge bunker. Such discharge bunkers, with which the same loose material is charged, are generally connected to the same storage bunker. The different discharge points of the conveyor ensure that the discharge bunker is filled as uniformly as possible over its length.

The conveyor comprises, for example, a fluidising channel with one or more discharge openings. Particularly uniform filling of the discharge bunker can be achieved with a conveyor comprising a fluidising channel with a discharge opening which extends radially essentially over the full length of the discharge bunker and in the direction of rotation and has a clearance which increases in the conveying direction.

Various embodiments of the invention are described below with the aid of the enclosed figures.

BRIEF DESCRIPTION OF THE DRAWINGS

FIG. 3 a section through a first embodiment of a charging device;

FIG. 3B a section through a heat protection shield under the charging device;

DETAILED DESCRIPTION OF THE PREFERRED EMBODIMENTS

Figure 1:
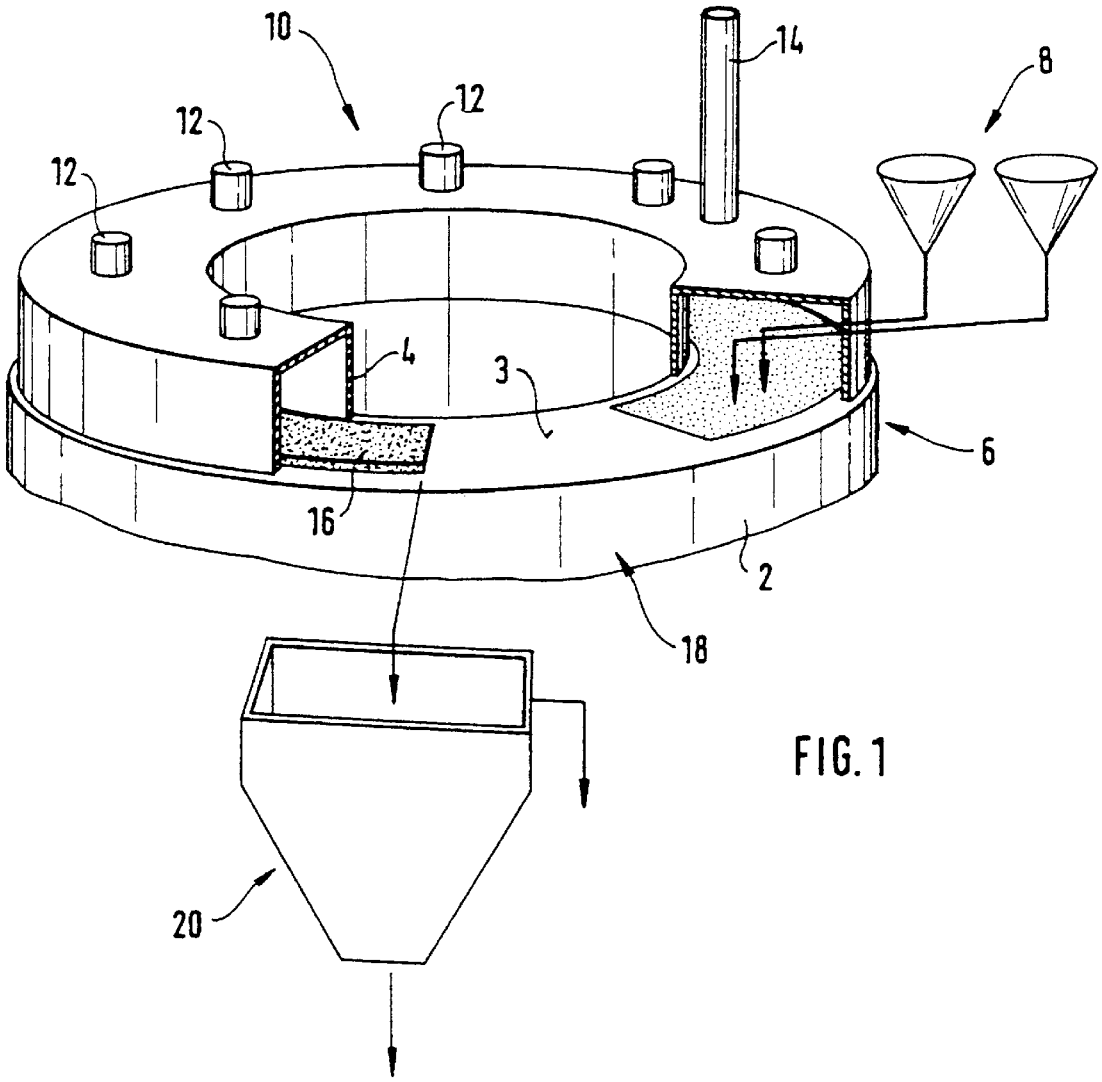
FIG. 1 shows a schematic general view of a rotary hearth furnace for the production of sponge iron.

A rotary hearth furnace for the production of sponge iron is shown schematically in FIG. 1. The furnace comprises an annular rotary hearth 2, with a furnace bed 3 with a refractory lining. The rotary hearth is pivoted on a foundation and enclosed on its top side by a housing 4 (for better understanding, the housing is shown partially sectioned). The reduction of iron, oxide, to directly reduced iron takes place inside the housing 4 in a controlled atmosphere at high temperatures of about 1300–1400° C. For this purpose fine-grained iron oxide and fine-grained coal dust are charged in separate layers above each other by means of a charging device 8 on to the refractory lining of the rotary hearth 2 in a first area 6 of the rotary hearth furnace. In this arrangement it is possible to charge only one layer of iron oxide and one of coal, or several layers of the individual materials can be placed alternately above each other.

After the charging, the iron oxide and coal dust enter the reaction area 10 of the rotary hearth furnace as a result of rotation of the rotary hearth 2. In this area 10 of the rotary hearth furnace burners 12, which heat the interior of the furnace to the required reaction temperature of about 1300–1400° C., are mounted in the housing 4. The hot waste gases of the burners 12 are conducted through the furnace by the counterflow method and subsequently removed through a chimney stack 14. In the inert atmosphere prevailing in the furnace the coal dust releases carbon monoxide, which reduces the iron oxide to iron.

After reduction in the reduction area 10 of the furnace is concluded, the finished sponge iron is present in pure form in one or more layers 16 one above the other. This sponge iron subsequently enters the discharge area 18 of the rotary hearth furnace, in which the sponge iron is removed from the furnace by a discharge device 20.

Figure 2:
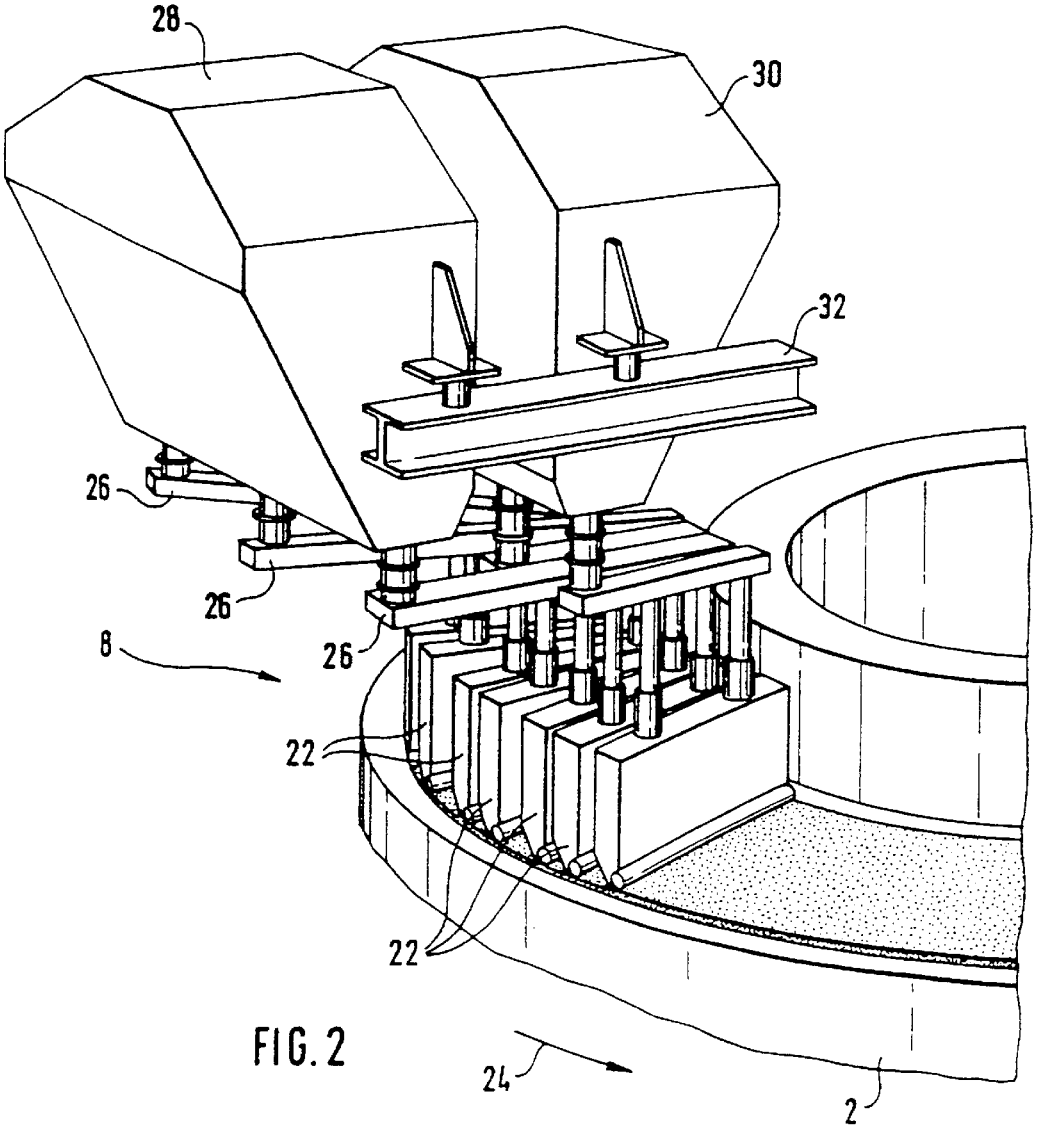
FIG. 2 a schematic general view of a charging device for the rotary hearth furnace according to FIG. 1.

A charging device 8 for charging several layers of fine-grained loose material one above the other is shown schematically in FIG. 2. It comprises several discharge bunkers 22, which are arranged one behind the other in the direction of rotation 24 (indicated by the arrow 24) of the rotary hearth and extend transversally to the direction of rotation 24 essentially over the full width of the annular surface of the rotary hearth 2. The discharge bunkers 22 are provided preferably in an odd number and charge coal dust and iron oxide alternately on to the rotary hearth 2, the first discharge bunker charging a bottom coal dust layer and the last discharge bunker covering the sequence of loose material layers with a top layer of coal dust.

The individual discharge bunkers 22 are each connected via their own conveyor 26 to a storage bunker 28 for iron oxide or a storage bunker 30 for coal dust, which are mounted on a supporting frame 32 above the discharge bunker 22. For space reasons the storage bunkers 28 and 30 can be arranged radially outside the actual furnace area, so that sufficient space remains in the centre of the rotary hearth furnace, e.g. for rotary connections for the possible supply of media to the rotary hearth 2, etc.

FIG. 3 shows a section in the direction of rotation through a discharge bunker 22. In its lower area it has a discharge hopper 34 with a discharge slot 36. The discharge slot 34 is formed by two edges 38 and 40, the first edge 38 resting on a pivoted discharge roller 42 and the second edge 40 being arranged a certain distance from the surface of the discharge roller 42. The diameter of the roller 42 and the position of the two edges 38, 40 relative to the roller 42 are fixed in such a way that discharge of fine-grained loose material 43 from the discharge bunker 22 when the discharge roller 42 is stationary is prevented. If, by contrast, the discharge roller 42 is driven by a drive 44 in the direction of the arrow 46, the fine-grained loose material 44, which flows freely from the discharge slot 36 on to the surface of the roller 42, is entrained by the discharge roller 42, a layer of loose material 48 being formed on the surface of the roller 42. The thickness of this layer of loose material 48 is advantageously determined by scraping at the edge 40, so that the layer thickness on the discharge roller 42 is essentially independent of the flow behaviour of the loose material 43. It is self-evident that the surface of the roller must have a structure which ensures adequate adhesion of the loose material 43 to the roller surface in order to ensure the further transport of the loose material to the falling zone.

A second roller 50 is mounted on the discharge side above the discharge roller 42 in front of the zone in which the gravitational force would cause slipping of the layer of loose material from the discharge roller 42. It forms with the discharge roller 42 a slot 52, the free cross-section of which is slightly smaller than the thickness of the layer of loose material 48. The roller 50 is driven via a drive 54 with a higher circumferential speed than the discharge roller 42, specifically in such a way that it accelerates the layer of loose material 48 relative to the surface of the discharge roller 42. In other words the roller 50 tears the layer of loose material 48 away from the discharge roller 42 before the gravitational force would cause slipping of the layer of loose material off the discharge roller 42 and consequently causes continuous falling of the loose material from the discharge roller 42.

The loose material falling from the discharge roller 42 falls on to a guide section 56, which is arranged under the discharge roller 42 in such a way that it guides the loose material in the direction of rotation (see arrow 58) on to the rotary hearth 2. On striking the rotary hearth the vertical velocity component of the loose material is consequently greatly reduced, so that interfering mixing of the layers above each other at the interfaces is effectively avoided. In FIG. 3 it is shown schematically how an additional loose material layer 60 is placed above two already existing layers 62 and 64.

It should be mentioned that a heat protection shield 66 is arranged between the rotary hearth 2 and the charging device 8 because of the intense heat radiated by the furnace bed 2. In this heat-insulated or mechanically cooled protective shield 66 radial slots 68 for loading the rotary hearth 2 are provided only under the discharge rollers 42. Insulated covers 70 allow the slots 68 to be covered when not in use. It should also be noted that the inclination of the slots 68 prevents direct irradiation of the discharge devices 22, 42 arranged above the slots 68.

FIG. 3B shows a section through a heat protection shield for a charging device for production of six layers arranged above each other on the rotary hearth 2. For this purpose six radial slots $\mathbf{68}_1$ to $\mathbf{68}_6$ are provided in the protective shield for loading the rotary hearth 2. A discharge roller (not shown in FIG. 3B) is arranged above each of these slots. It can be seen that the height of the gap between the bottom edge of the guide sections $\mathbf{56}_1$ to $\mathbf{56}_6$ and the surface 3 of the furnace bed increases in the direction of rotation. This height corresponds essentially to the total height of the layers already deposited on the rotary hearth. Consequently all guide sections $\mathbf{56}_1$ to $\mathbf{56}_6$ can always deposit the loose material on the rotary hearth in an optimum manner, i.e. without mixing with the previous layer.

According to the embodiment in FIG. 3 the discharge bunkers 22 are all suspended in such a way that their weight can be determined separately. For this purpose a refilling pipe 72, which connects the discharge bunker 22 to the conveyor 26 or the storage bunker 28, 30, must ensure a certain freedom of vertical movement. This can be achieved, for example, by the installation of an axial compensator in the refilling pipe 72. Furthermore, the discharge bunker 22 must not be incorporated rigidly in the casing 4 of the rotary hearth furnace. This problem is solved by incorporating the discharge bunkers in the casing via channels 74 filled with a liquid. The discharge bunker 22 disconnected in this way from the rest of the device with regard to its weight is supported in a supporting structure by a continuous weighing device. In FIG. 3 this supporting structure is shown schematically as a fixed point 75 and the weighing device as a lever arm 76. However, the weighing device may also comprise already known weight measuring cells, which are then used as supports for the discharge bunker 22.

The measuring signal of the weighing device 76 is transmitted to a controller 78, which determines a time-related weight reduction of the discharge bunker and thus the discharge rate of the loose material 43. As the output signal of this controller 78 is used as the input signal for the speed control 79 of the drive 44, the discharge rate of the roller 42 can thus be controlled continuously. Consequently, the build-up of the loose material layer 60 can be regulated gravimetrically. In other words the apparent density (kg loose material/$m^2$ hearth surface) in each layer can be adjusted continuously.

Figure 4:
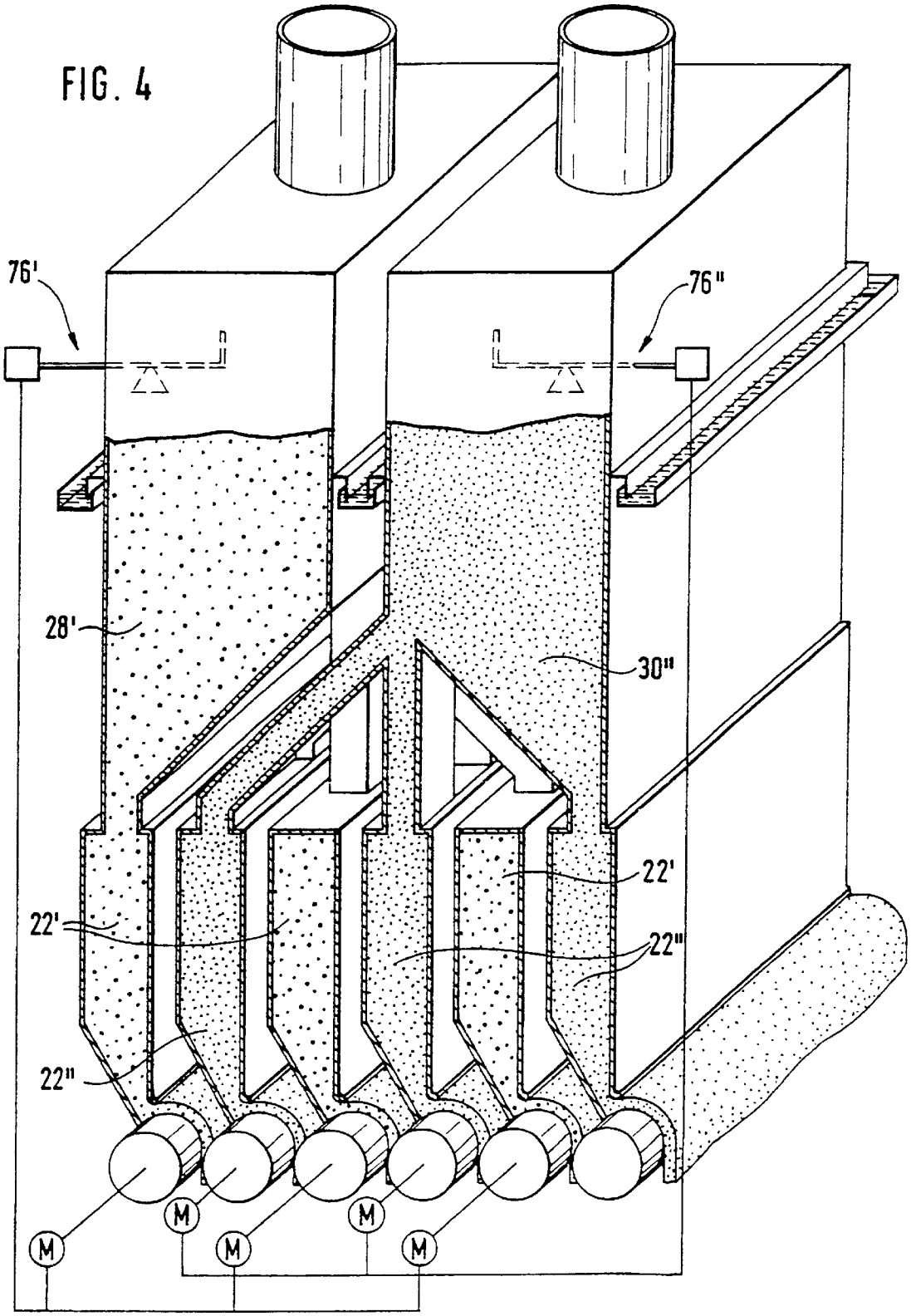
FIG. 4 a section through a second embodiment of a charging device.

According to the embodiment in FIG. 4 the discharge bunkers 22', 22" form a common suspended unit with their associated storage bunkers 28, 30, the total weight of which is determined via a continuous weighing device 76', 76". In this embodiment only the overall apparent density of a loose material on the rotary hearth 2 can be adjusted.

It should also be noted with regard to the discharge bunkers 22 that their discharge hopper 34 is preferably designed in such a way that the total weight of the column of loose material in the discharge bunker 22 rests on one or more walls of the discharge hopper 34. Consequently, it is not essential for the discharge rollers 42 to be suspended from the discharge bunkers 22 in order to measure the discharge rate of the device relatively accurately via a change in weight of the bunker. In addition compacting of the loose material layer on the discharge roller 42 is avoided.

Figure 5:
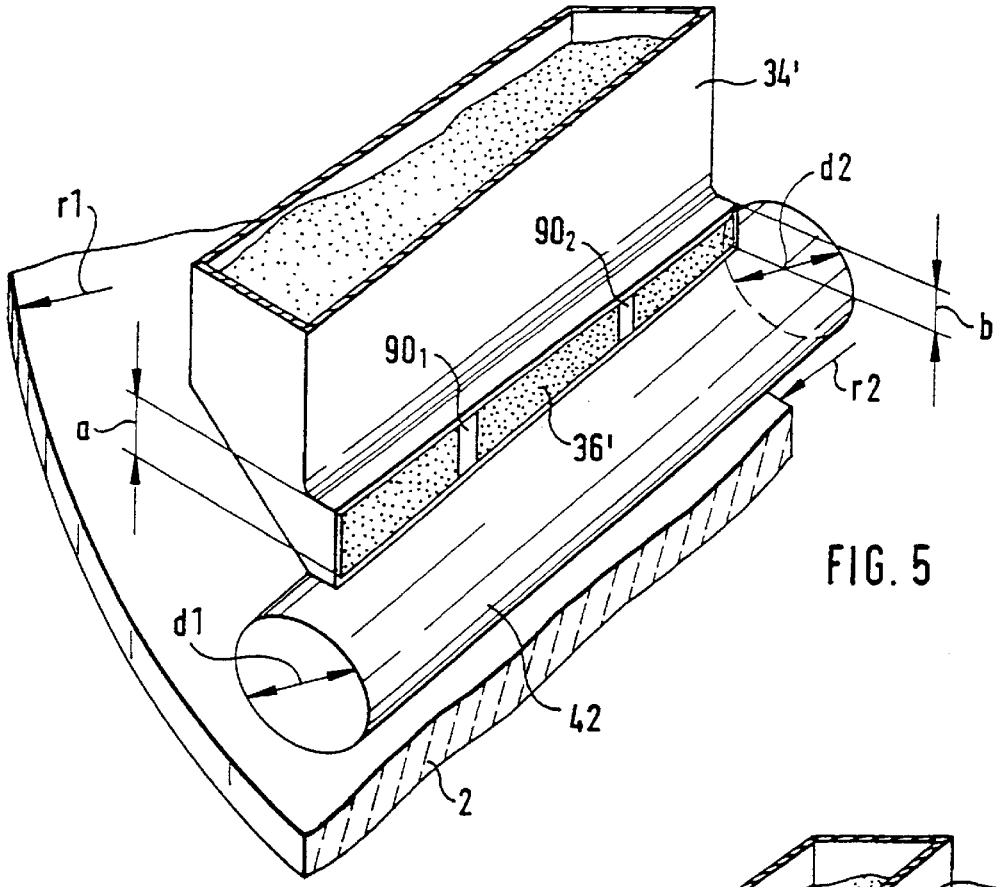
FIG. 5 a perspective view of a first embodiment of a discharge device on a charging device.
Figure 6:
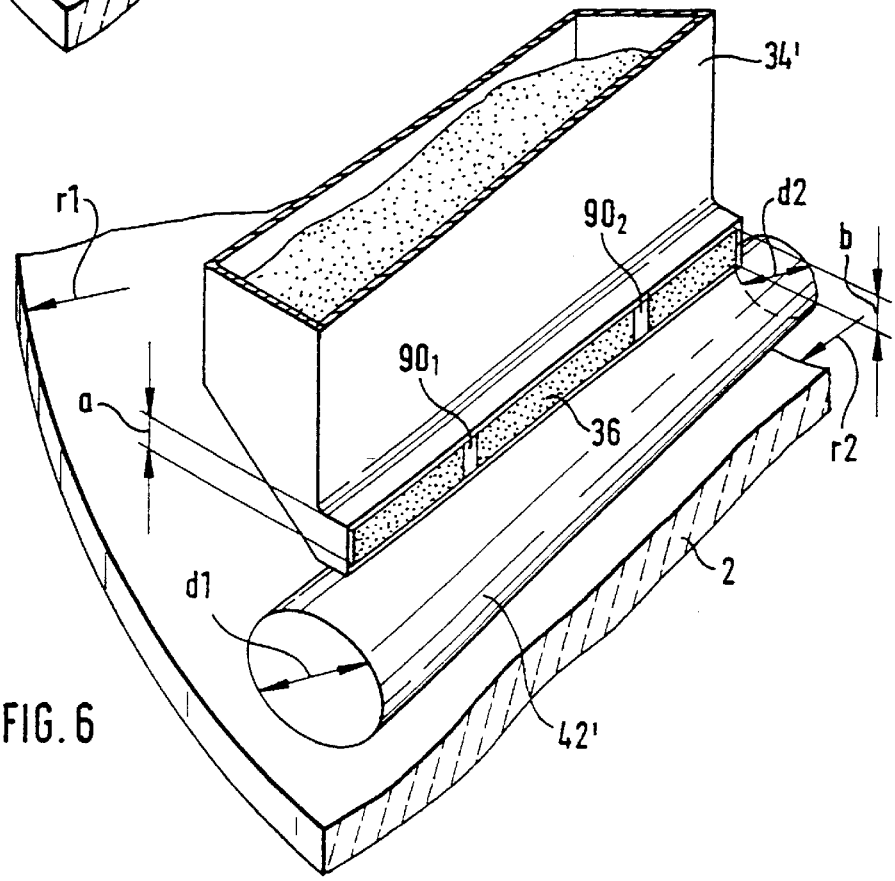
FIG. 6 a perspective view of a second embodiment of a discharge device on a charging device.

FIGS. 5 and 6 show two advantageous embodiments of the discharge device, which permit a relatively uniform layer build-up over the full width of the rotary hearth to be ensured despite different circumferential speeds of the rotary hearth along the discharge roller 42.

In FIG. 5 the discharge roller 42 is of cylindrical design, i.e. its circumferential speed is always the same. However, the inside height of the discharge opening 36' increases in proportion to the distance from the centre of the rotary hearth. Consequently the thickness of the loose material layer on the discharge roller 42 likewise diminishes from the outside inwards in proportion to the distance from the centre of the rotary hearth and the apparent density is consequently essentially the same over the full width of the rotary hearth.

In FIG. 6 the discharge roller 42' is of conical design, whereas the inside height of the discharge opening 36 of the discharge hopper 34' is constant over the full width. However, the diameter of the conical discharge roller 42' increases in proportion to the distance from the centre of the rotary hearth. The circumferential speed and thus the discharge rate of the discharge roller 42 diminish in proportion to the reduction of the circumferential speed of the rotary hearth 2 from the outside inwards and the apparent density is consequentially essentially the same over the full width of the rotary hearth.

Figure 7:
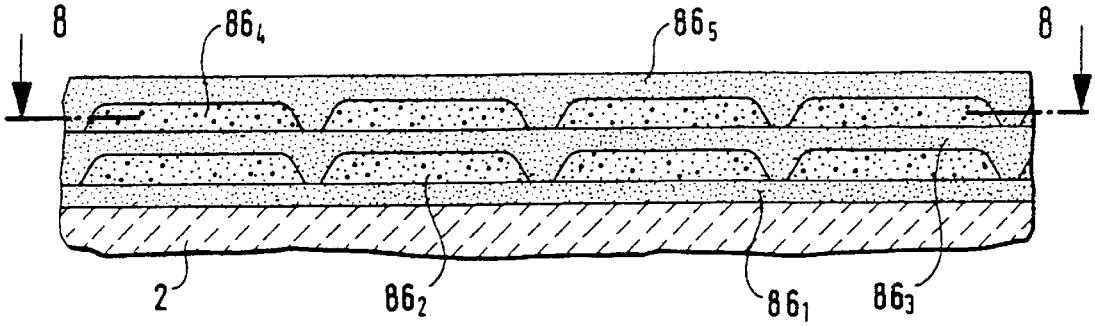
FIG. 7 a cross-section through layers, which can be achieved with a device according to the invention.
Figure 8:
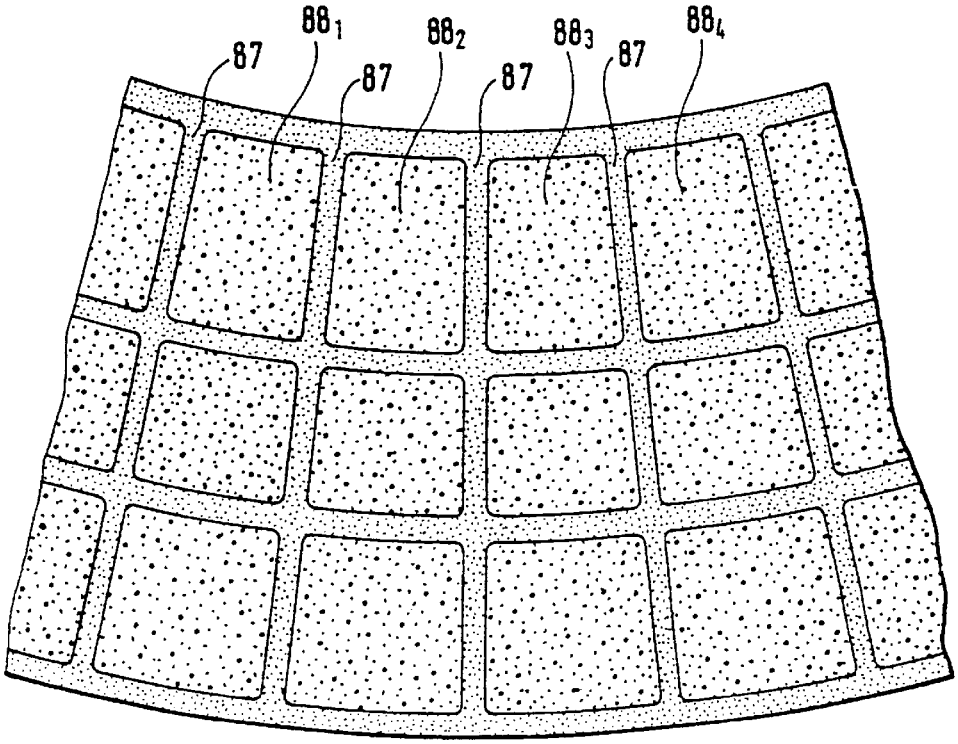
FIG. 8 a longitudinal section along the section plane 8—8 through the layers in FIG. 7.

A multi-layer charging profile, which can be achieved with a device according to the invention, is shown in FIGS. 7 and 8. The charging profile has two iron oxide layers $\mathbf{86}_2$ to $_{864}$ and three coal layers $\mathbf{86}_1$, $\mathbf{86}_3$, $\mathbf{86}_5$ deposited one above the other. Whereas the coal layers $\mathbf{86}_1$, $\mathbf{86}_3$, $\mathbf{86}_5$ were charged continuously over the width of the rotary hearth 2, the iron oxide layers $\mathbf{46}_2$, $\mathbf{46}_4$ are subdivided into three separate rings next to each other (see FIG. 8). The latter are in turn subdivided by radial interruptions 87 into individual areas $\mathbf{88}_1$, $\mathbf{88}_2$, $\mathbf{88}_3$, $\mathbf{88}_4$. The radial interruptions 87 are produced by briefly stopping the discharge rollers 42. Alternatively they could also be achieved, however, by briefly closing the discharge opening 36 of the discharge hopper 34 by a closing element, e.g. a slide valve. The annular interruptions are achieved by teeth $\mathbf{90}_1$, $\mathbf{90}_2$ in the discharge openings 36 of the discharge bunkers 20, which interrupt the loose material layer on the discharge roller 42. The subdivision of the iron oxide layers $\mathbf{46}_2$, $\mathbf{46}_4$, into non-contiguous areas $\mathbf{88}_1$, $\mathbf{88}_2$, $\mathbf{88}_3$, $\mathbf{88}_4$ causes the sponge iron to be present in the form of sheets next to each other after the reduction and thus facilitates further processing of the sponge iron. It should be noted that the annular interruptions can also be achieved by bars running in the direction of rotation, which are arranged in the slots 68 in the heat protection shield 66.

Figure 9:
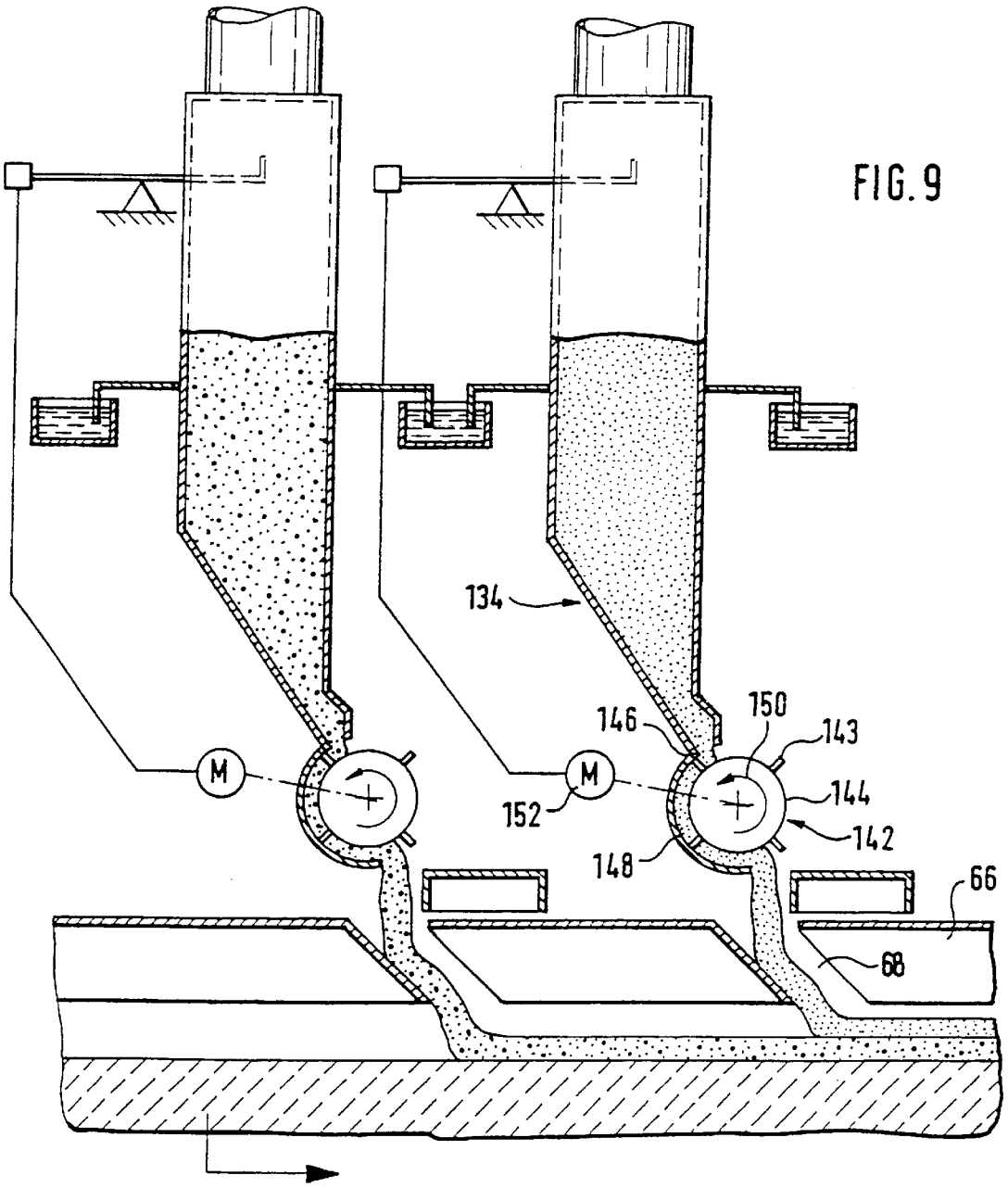
FIG. 9 a section through a further embodiment of a charging device.

A further advantageous embodiment of the discharge rollers is shown in FIG. 9. These discharge rollers 142 comprise cells 144 radially open on the outside and subdivided by bars 143, which are filled with fine-grained loose material from the discharge hopper 134. The lower edge 146 of the discharge hopper 134 is connected to a casing 148, which encloses the roller 142 as far as the discharge zone immediately above the slot 68 in the protective shield 66 resting on its full length. In other words the bars 143 extending radially outwards, which are located in the area of the casing 148, rest directly on the latter. The direction of rotation of the discharge roller 142 is indicated by the arrow 150. The reference number 152 shows a variable-speed drive, which allows the device in FIG. 9 to be operated as described above with reference to the device in FIG. 3.

Several advantageous embodiments of a conveyor 26 for conveyance of the fine-grained loose material from the respective storage bunker 28, 30 to the discharge bunker 22 are shown in FIGS. 10 to 16. Such a conveyor 26 may comprise, for example, a chain conveyor or screw conveyor and preferably has several discharge points into the discharge bunker 22, so that the discharge bunker 22 is fed as uniformly as possible over its length transversally to the direction of rotation.

Figure 10:
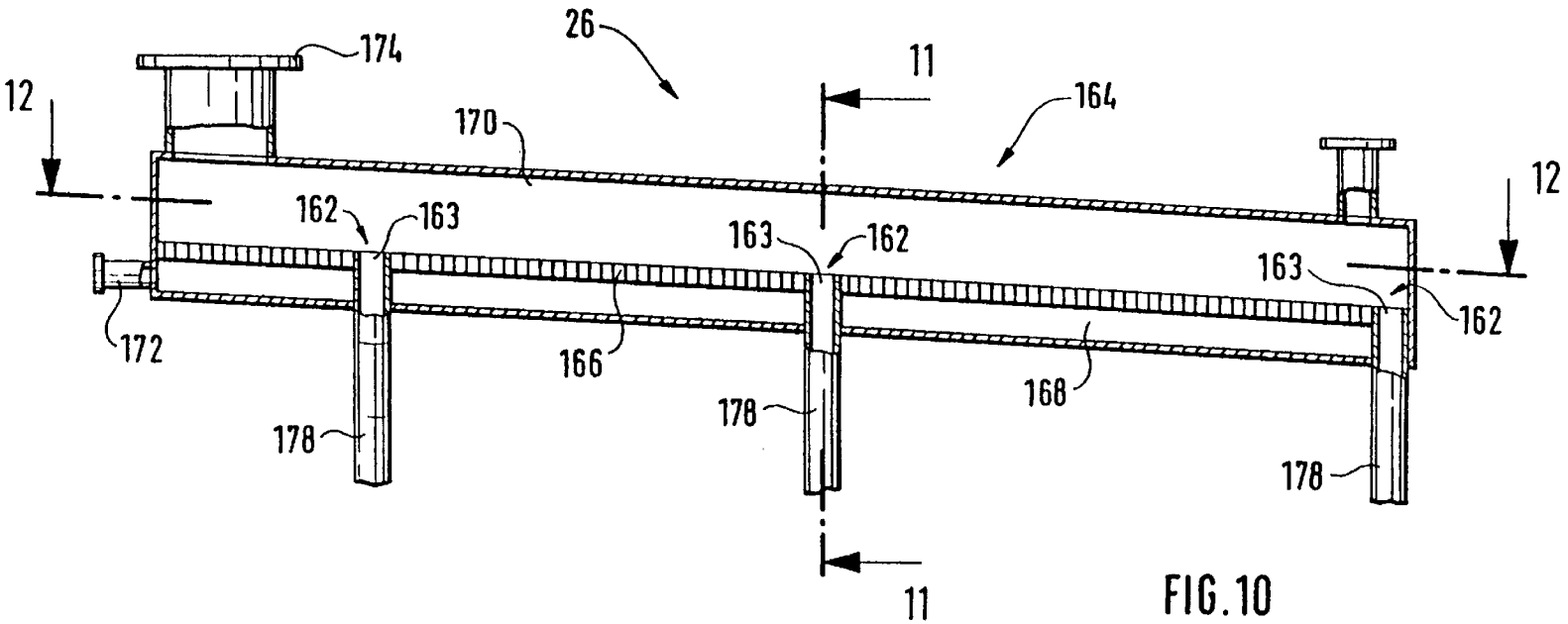
FIG. 10 a longitudinal section through a conveyor for conveyance of the fine-grained loose material into the discharge bunker.
Figure 11:
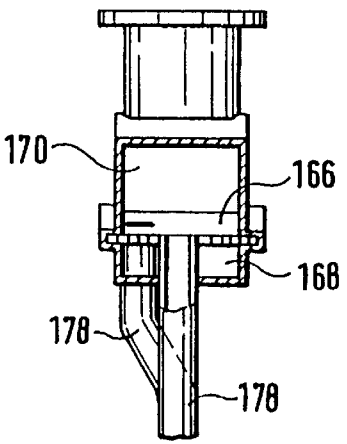
FIG. 11 a section along the section line 11—11 through the device in FIG. 10.
Figure 12:
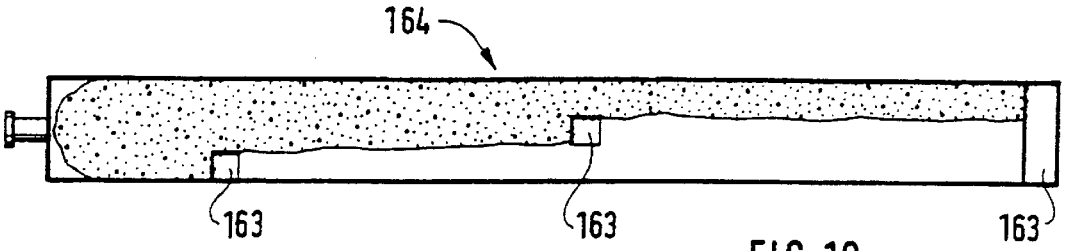
FIG. 12 a section along the section line 12—12 through the device in FIG. 10.
Figure 13:
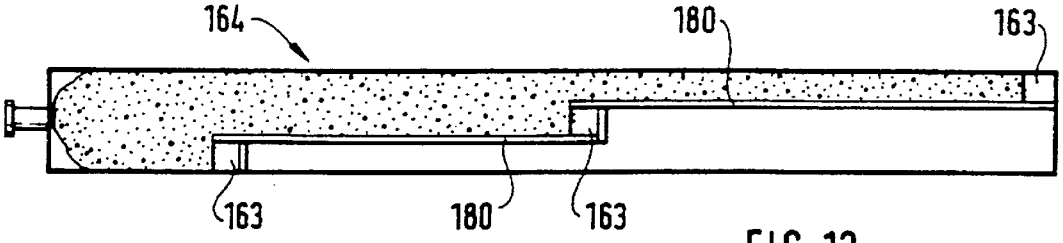
FIG. 13 a section along the section line 12—12 through a variant of the device in FIG. 10.

An advantageous embodiment of a conveyor 26 is shown as a longitudinal section in FIG. 10. It consists of a fluidising channel 26, which has several discharge points 162, to the bottom of which the refilling pipes 72 of a discharge bunker 22 are connected. The number of discharge points 162 may vary according to the length of the discharge bunker 22; it will generally be between two and five.

The fluidising channel 26 has a closed duct 164 falling in the conveying direction, which is subdivided inside by a gas-permeable, e.g. ceramic, partition 166 into a lower gas duct 168 and an upper conveying duct 170. A gas inlet 172 is connected to an inert gas source, which feeds inert gas under pressure as fluidising gas into the gas duct 168. The fluidising gas then passes through the pores in the gas-permeable partition 66, converts fine-grained loose material in the conveying duct 70 into a fluidised condition and is subsequently returned via a gas outlet 176.

The conveying duct 170 has on its top side a loose material inlet duct 174, which is connected to the respective storage bunker 28, 30. The iron oxide or coal dust passes through this loose material inlet duct 174 to the conveying duct 170, is converted in the latter into a fluidised condition and is conveyed by virtue of the inclination of the duct 164 (e.g. 5–10° ) to the lower discharge points 162. The discharge points 162 are formed by discharge openings 163 in the partition 166, to which outlet connection pieces 178, which extend downwards through the gas duct 68 and emerge at the bottom of the duct 166, are connected. These outlet connection pieces 178 are connected to the refilling pipes 72 of the discharge bunker 22 so that loose material transfer into the discharge bunker 22 is made possible.

The discharge openings 163 are preferably offset transversely to the conveying direction of the conveyor 26 in such a way (see FIG. 12) that only part of the conveyed loose material falls into the respective opening, while the remainder of the loose material is conveyed to the following discharge opening 163. The last discharge opening 163 preferably extends over the full width of the partition, so that all the remaining loose material is removed from the fluidising channel 26. Alternatively bars 180, which run in the conveying direction of the fluidising channel 26 and conduct the loose material to the respective discharge openings 163, can be arranged in the conveying duct 170 (see FIG. 13).

Figure 15:
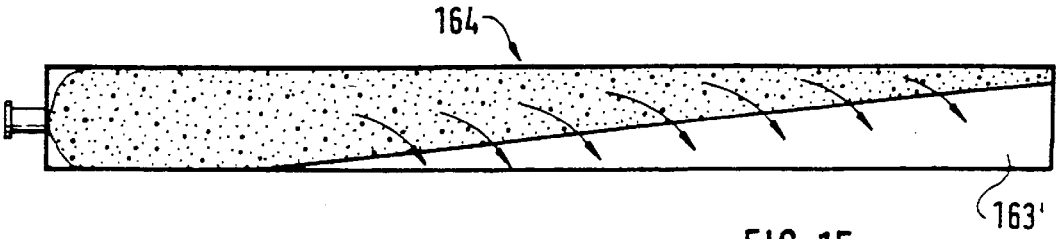
FIG. 15 a section through the device in FIG. 14, the section plane corresponding to the section plane in FIGS. 12 and 13.
Figure 14:
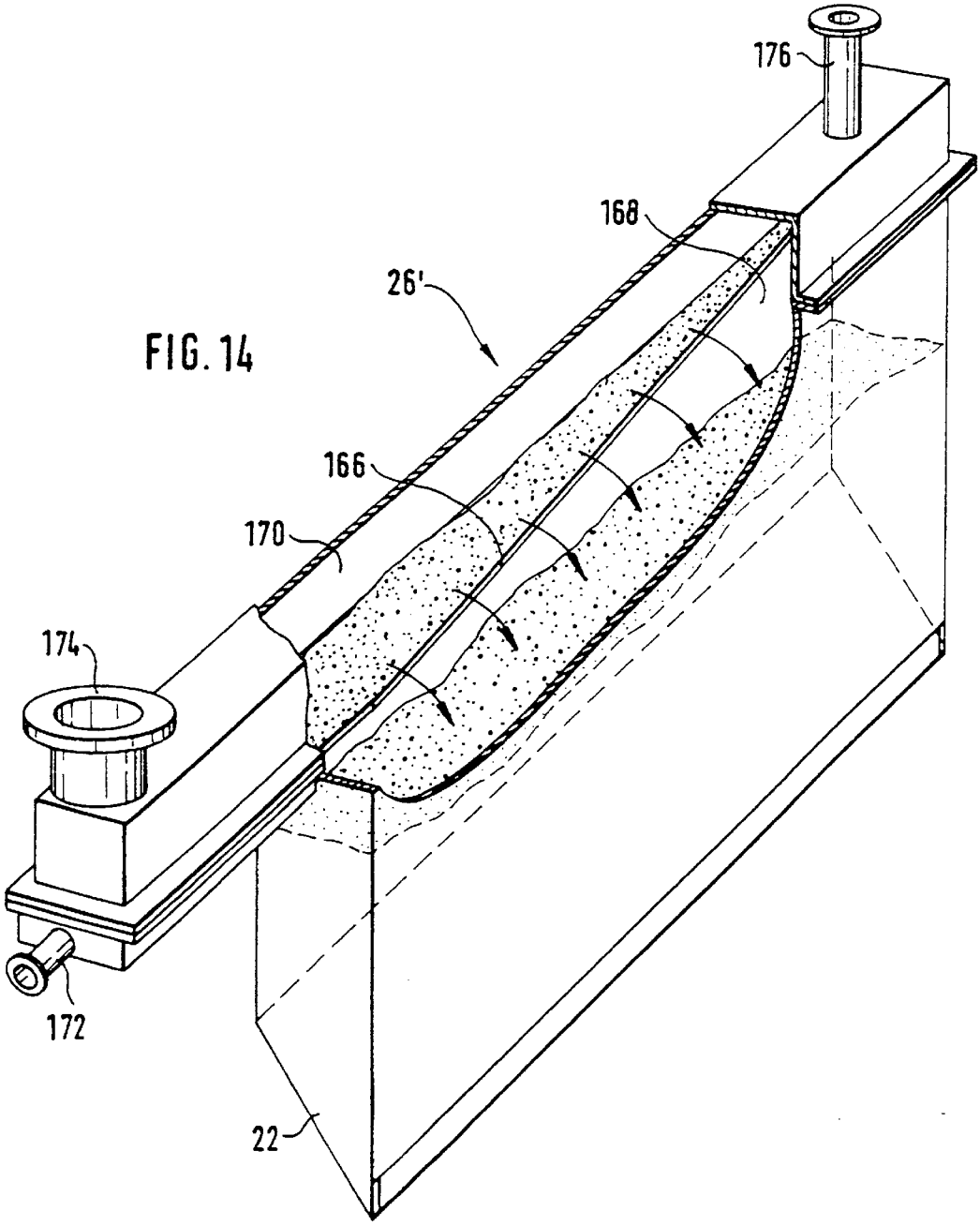
FIG. 14 a perspective view; partially sectioned, of a further variant of the device in FIG. 10 with a connected discharge bunker.

Particularly uniform filling of the discharge bunker 22 is made possible with the embodiment of the conveyor 26' shown in FIGS. 14 and 15. It comprises a fluidising channel with a discharge opening 163', which is designed in such a way that it forms discharge points over the full length of the discharge bunker 22. The discharge opening 163' extends radially essentially over the full length of the discharge bunker 22, whereas it has a clearance increasing in the conveying direction transversely to the latter. The fluidising channel 26' is flange-connected directly to the discharge bunker 22 open at the top. Hence the loose material flow, which is distributed under the loose material inlet duct 174, over the full width of the duct 170, is continuously cut at the widening discharge opening 163 during further transport and the discharge bunker 22 is consequently fed uniformly over its full length.

What is claimed is:

1. A rotary hearth furnace, comprising:

a rotary hearth; and a charging device for production of layers of fine-grained loose material one above the other on said rotary hearth, said charging device including for each loose material layer:

a discharge bunker with a discharge slot, a discharge roller arranged under said discharge slot, a variable speed drive associated with said discharge roller, and a guide section arranged under said discharge roller;

wherein said discharge slot and said discharge roller extend essentially transversely to a direction of rotation of said rotary hearth, and said guide section is arranged in such a way that the loose material falling from said discharge roller falls on to said guide section and is guided by the guide section on to said rotary hearth.

2. The rotary hearth furnace according to claim 1, further comprising:

a common storage bunker to which at least two of said discharge bunkers are connected in such a way that the discharge bunkers are movable in a vertical direction relative to said common storage bunker;

a weighing device associated with each of said discharge bunkers so as to be capable of continuously weighing said discharge bunker; and a controller associated with said weighing devices, said controller being capable of determining a discharge rate of each of said discharge bunkers and of controlling said variable speed drive of said discharge roller of said respective discharge bunker responsive to said discharge rate.

3. The rotary hearth furnace according to claim 1, further comprising:

a common storage bunker supporting at least two of said discharge bunkers;

a weighing device associated with said common storage bunker so as to be capable of continuously weighing said common storage bunker with its discharge bunkers; and a controller associated with said weighing device, said controller being capable of determining a total discharge rate of said discharge bunkers and of controlling said variable speed drives of said discharge rollers of said discharge bunkers of said common storage bunker responsive to said total discharge rate.

4. The rotary hearth furnace according to claim 1, comprising a heat protection shield arranged between said rotary hearth and said charging device, said heat protection shield having a radial slot under each of said discharge rollers for charging said rotary hearth.

5. The rotary hearth furnace according to claim 1, wherein said guide sections are arranged in such a way that they form a gap relative to a surface of said rotary hearth, the height of said gap corresponding approximately to a total height of the loose material layers already deposited on said rotary hearth.

6. The rotary hearth furnace according to claim 1, wherein said discharge bunker has a discharge hopper with a slot-type discharge opening formed between a first and a second free edge, wherein said first edge rests against said discharge roller, and said second edge is arranged a certain distance from a surface of said discharge roller so as to form between said discharge roller and said second edge a discharge slot that determines a layer thickness of the loose material on said discharge roller by scraping.

7. The rotary hearth furnace according to claim 6, wherein a height of said discharge slot diminishes toward a center of said rotary hearth.

8. The rotary hearth furnace according to claim 6, further comprising a driven separating roller associated with said discharge roller, said separating roller defining with said discharge roller a second discharge slot, wherein a height of the second discharge slot is slightly smaller than the height of said discharge slot between said discharge roller and said second edge.

9. The rotary hearth furnace according to claim 1, wherein said discharge bunker has a discharge hopper that is designed in such a way that a full weight of the loose material in said discharge bunker rests on walls of said discharge hopper.

10. The rotary hearth furnace according to claim 1, wherein said discharge roller is of conical design, in such a way that its diameter diminishes toward a center of said rotary hearth.

11. The rotary hearth furnace according to claim 1, wherein said discharge roller has cells for the loose material.

12. The rotary hearth furnace according to claim 11, comprising a casing that is connected to a first edge of said discharge bunker and encloses said discharge roller as far as a location where the loose material leaves the discharge roller.

13. The rotary hearth furnace according to claim 1, further comprising:

a housing enclosing said rotary hearth on its upper side; and liquid containing channels by means of which said housing is connected in a sealed manner to said charging device.

14. The rotary hearth furnace according to claim 1, further comprising:

a common storage bunker, and a conveyor connecting one discharge bunker to said storage bunker, wherein said conveyor is designed so as to have several discharge points into said discharge bunker.

15. The rotary hearth furnace according to claim 14, wherein said conveyor has a fluidizing channel with at least one discharge opening.

16. The rotary hearth furnace according to claim 15, wherein said fluidizing channel has a discharge opening that extends radially essentially over a full length of said discharge bunker and that has, in a direction of rotation, a clearance that increases in a conveying direction of the conveyor.

* * * * *